United States Patent [19]

Vandervort

[11] 4,040,383

[45] Aug. 9, 1977

[54] FUSER ROLL LUBRICATOR-CLEANER

[75] Inventor: John D. Vandervort, Cottage Grove, Minn.

[73] Assignee: Minnesota Mining and Manufacturing Company, St. Paul, Minn.

[21] Appl. No.: 663,682

[22] Filed: Mar. 4, 1976

[51] Int. Cl.[2] ..... B05C 11/00

[52] U.S. Cl. ..... 118/60; 101/367; 118/260; 118/262

[58] Field of Search ..... 118/60, 70, 203, 104, 118/260, 262; 69/30; 222/169, 170; 101/331, 367

[56] References Cited

U.S. PATENT DOCUMENTS 2,237,429 4/1941 Harrington ..... 118/70

FOREIGN PATENT DOCUMENTS 97,948 9/1924 Austria ..... 101/367

580,370 7/1933 Germany ..... 101/367

816,104 10/1951 Germany ..... 101/367

*Primary Examiner*—Dorsey Newton

*Attorney, Agent, or Firm*—Cruzan Alexander; Donald M. Sell; Philip A. Dalton, Jr.

[57] ABSTRACT

Apparatus for uniformly applying toner-release lubricant to, and for cleaning, heated fusing rolls used in copying or reproduction machines. The apparatus comprises a lubricant-dispensing roll containing an internal supply of lubricant; an applicator roll for transferring lubricant from the dispenser roll to the fuser roll and for wiping the fuser roll; and a spreader roll for evenly distributing the lubricant on the applicator roll prior to the completion of transfer to the fuser roll. The dispenser roll is designed to (1) dispense lubricant uniformly and substantially continuously over approximately 270° of each revolution, regardless of the oil level therein, and (2) preclude the dispensing of lubricant when not in use.

10 Claims, 7 Drawing Figures

FUSER ROLL LUBRICATOR-CLEANER

BACKGROUND OF THE INVENTION

1. Field of the Invention

This invention relates to copying machines which utilize heated fusing rolls to fix images defined by toner and, in particular, to apparatus for lubricating and cleaning fusing rolls.

2. Description of the Prior Art

Hot fusing systems in copying machines frequently use a heated fusing roll in conjunction with a backup roll. An advancing sheet of paper having toner applied to the surface in an electrophotographically-derived image pattern passes through the nip formed by the fusing roll and backup roll, where the image is fixed.

Off-setting of toner onto the fusing roll and concomitant sticking of the copy sheet of the fusing roll is a frequent problem in hot roll fusing processes. The result is degradation of the copy and decreased operating life for the fusing roll, as well as possible destruction of the copy and jamming of machine. Off-setting and sticking can be alleviated by applying an elastomeric surface coating to the fusing roller enhance toner release capability.

Release is also enhanced and the life of the roll extended by using a release lubricant such as silicone oil. Typically, the silicone oil release lubricant is applied to the fusing roll by a sponge-like or wick-like material which is immersed in a tank of silicone oil. Unfortunately, the use of such systems make it difficult to control the application of the silicone oil so that sufficient oil is applied to release the toner without staining the copy. Particularly after periods of inactivity, the silicone oil may build up excessively in the wick. Also, the wick tends to become clogged with toner and to lose effectiveness fairly quickly.

Various approaches have been used in attempting to improve the performance of wick-like applicators. For example, U.S. Pat. No. 3,718,116 uses an applicator roll to apply lubricant to a main wick contacting the fuser roll and uses an auxiliary wick to promote uniform application of the lubricant to the applicator. U.S. Pat. No. 3,831,553 utilizes a sponge inserted between the main wick, the auxiliary wick and the applicator roll of the aforementioned U.S. Pat. No. 3,718,116 . A different approach is provided by U.S. Pat. No. 3,883,291 in that a wiper is applied directly to the fuser roll to remove excess release liquid applied by a sponge-like applicator. Also, the contact pressures of the wiper and the applicator against the fuser roll are varied to control the application of the liquid to the fuser roll and the effectiveness of the wiper.

From the above, it will be appreciated that it is desirable to have a non-wick-like, release lubricant applicator system which is durable and applies the release liquid uniformly, thus avoiding the problems associated with wick-like applicators and the necessity for resorting to complicating application systems for wick-like applicators.

SUMMARY OF THE INVENTION

The present invention provides an improved apparatus for lubricating and cleaning a heated fuser roll. The apparatus comprises a roll for transferring lubricant to the fuser roll from a cooperating lubricant-dispensing roll. The lubricant-dispensing or lubricator roll comprises a first hollow, rotatable cylinder having an axial array of apertures and a second hollow cylinder fixedly mounted within the first cylinder for rotation therewith. The outer surface of the second cylinder defines a narrow annular cavity with the interior surface of the first cylinder; the inner surface of the second cylinder defines a reservoir for lubricant. The second cylinder has a longitudinal slotted opening defined by an inward-extending flange adjacent the opening which directs lubricant from the interior of the second cylinder into the cavity and by an outward-extending flange contacting the interior of the first cylinder which closes the trailing end of the cavity adjacent the apertures. This arrangement provides discharge of the lubricant from the apertures of the first cylinder for approximately 270° of rotation of the lubricator roll independent of the level of lubricant in the reservoir.

DETAILED DESCRIPTION

Figure 2:
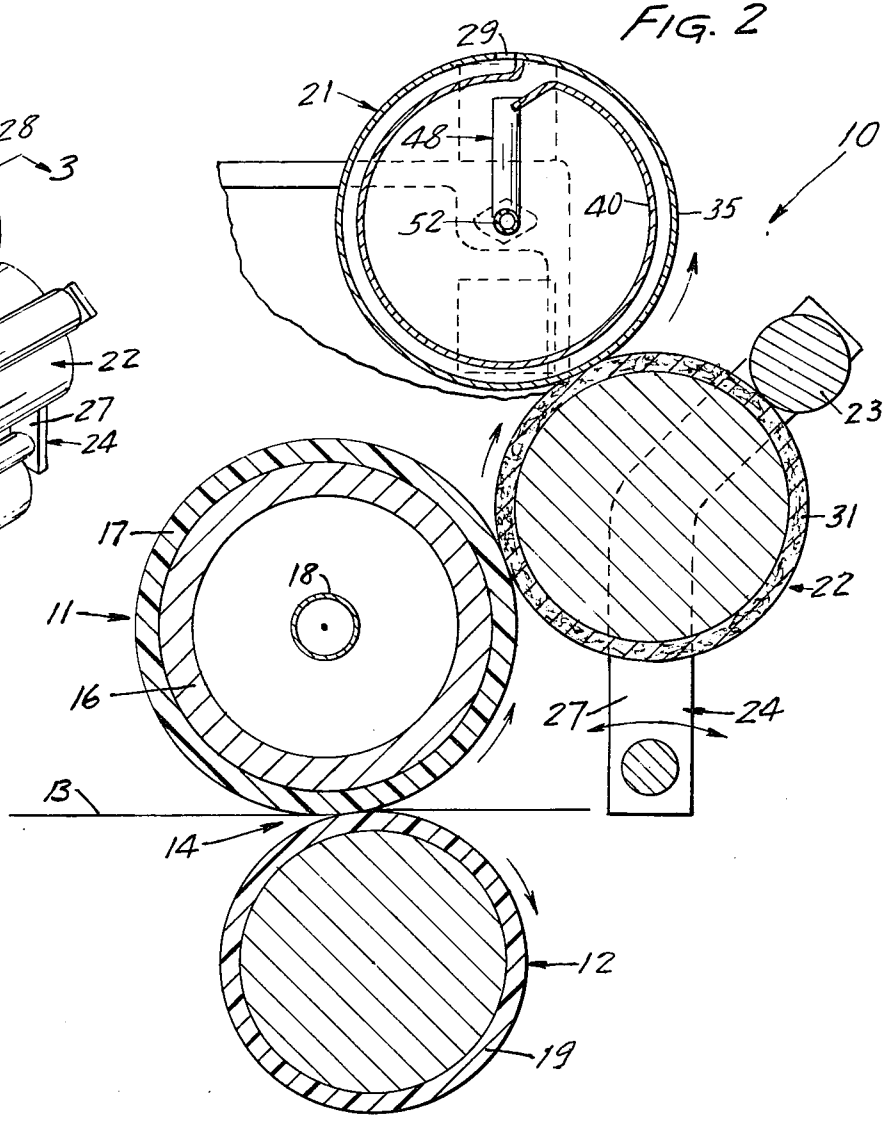
FIG. 2 is a cross-sectional view of the lubricating and cleaning apparatus of the present invention, taken along lines 2—2 in FIG. 1.
Figure 1:
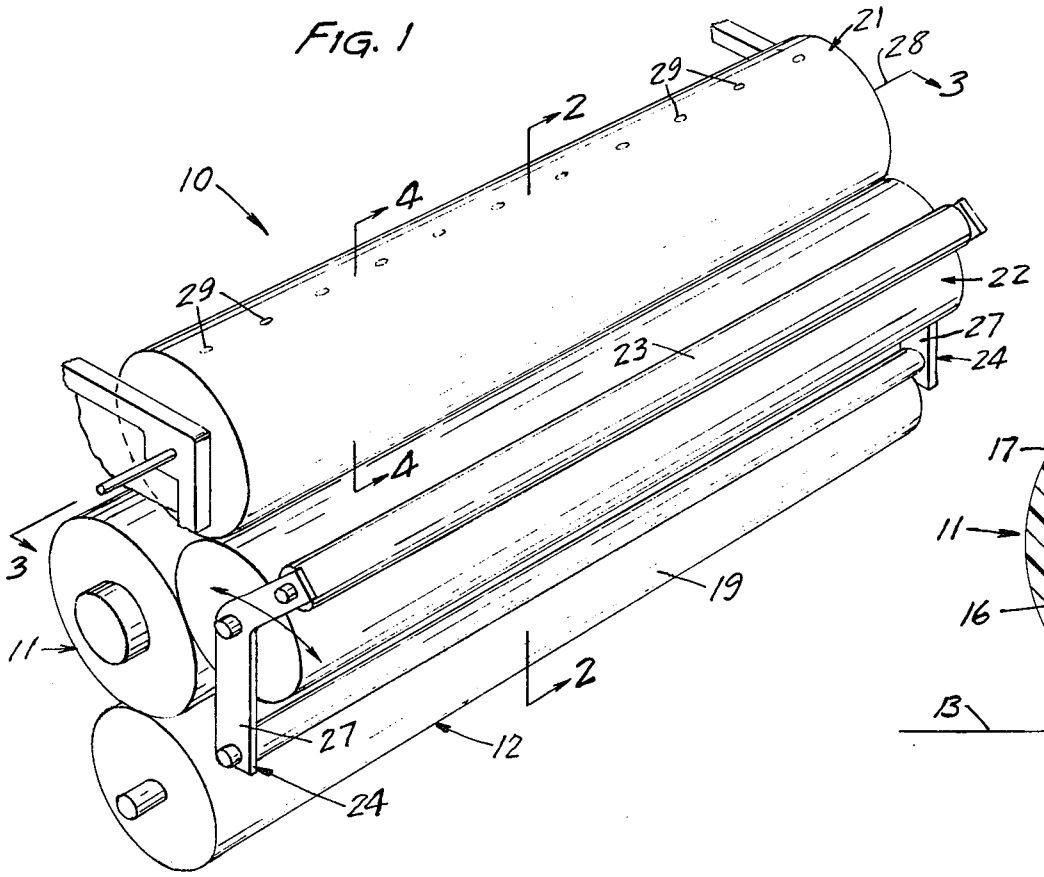
FIG. 1 is a perspective representation of a hot roll fusing assembly of a copying machine which utilizes lubricating and cleaning apparatus incorporating the principles of the present invention.

Referring now to FIGS. 1 and 2, there is shown a hot roll fusing assembly of a copying machine which utilizes a heated fuser roll 11 and a backup roll 12. An advancing sheet of paper 13, having toner applied to the upper surface thereof in an electrophotographically-derived image, passes through a nip 14 formed by the backup roll 12 and the fuser roll 11, where the toner image is fixed.

Referring further to FIG. 2, the illustrated fuser roll 11 comprises a metal portion 16 having an elastomeric surface coating 17. Heat is supplied by a lamp 18 mounted within the roll 11. The backup roll 12 also has an elastomeric surface coating 19. Typically, the elastomeric coatings are applied by spraying and are 0.038–0.064 mm thick. The elastomeric fuser roll coating 17 functions as a release agent for preventing the toner image from offsetting onto the fuser roll and preventing the copy paper 13 from sticking to the fuser roll.

As stated previously, it is desirable to apply a toner release lubricant to the fuser roll 11 and to clean the roll. FIGS. 1 and 2 illustrate the application of the principles of the present invention to provide apparatus 10 for the copy machine which performs these functions. That is, and in a preferred embodiment, a lubricator-dispensing or lubricator roll 21 acts in conjunction with an applicator roll 22 and a spreader roll 23 to apply lubricant to and clean the fuser roll 11. Because silicone oil provides excellent lubricating qualities and is compatible with elastomeric surfaces, hereinafter the lubricant is considered to be silicone oil.

Referring further to the lubricating and cleaning apparatus 10 shown in FIGS. 1 and 2, the applicator roll 22 is mounted for rotational movement of a pair of angled brackets or arms 24—24. The brackets are mounted to the copier (not shown) for pivotal movement at first ends 27—27 thereof and rotatably mount the spreader roll 23 in frictional engagement with the applicator roll 22. The lubricator roll 21 is also mounted to the frame (not shown) of the copier, typically along longitudinal axis 28 (FIG. 1). As indicated by the arrows in FIGS. 1 and 2, the angled brackets 24—24 are pivotable, by any suitable means (not shown), to bring the applicator roll 22 into simultaneous engagement with the fuser roll 11 and the lubricator roll 21.

In the illustrated exemplary arrangement, although certainly not the only satisfactory one, the fuser roll 11 and the applicator roll 22 can be operated by the same gear or belt drive system (not shown) while the lubricator roll 21 and the spreader roll 23 are rotated by frictional engagement with the applicator roll 22. In operation, with the applicator roll 22 rotatably engaging the fuser roll 11 and the lubricator roll 21, the rotating lubricator roll applies silicone oil contained therein via a series of apertures 29—29 onto surface 31 (FIG. 2), of the applicator roll. The applicator roll surface 31 typically is a coating or covering of absorbent material, such as polyester felt. The spreader roll 23 provides a squeegee action which spreads the oil evenly over the applicator roll surface 31 for uniform application of the oil to the fuser roll 11. During this application, the absorbent surface 31 also removes any toner from the surface 17 (FIG. 2) of the fuser roll 11. The toner removal results from a differential in rotational speeds which induces a "wiping" action.

Figure 3:
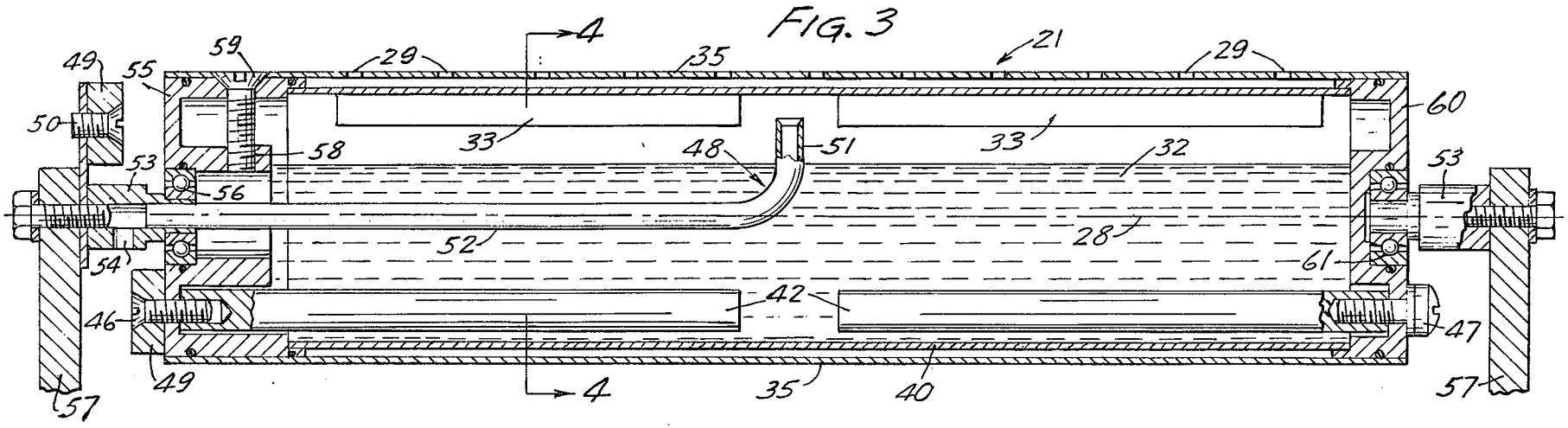
FIG. 3 is a longitudinal cross-sectional view of the lubricator roll of the present invention, taken along the lines 3—3 in FIG. 1.

The use and structure of the lubricator roll 21 are crucial to the operation of the lubricator-cleaner apparatus 10. The internal structure of the lubricator roll 21 is shown in FIG. 3, which is a longitudinal cross-sectional representation, and in FIGS. 4A -4D, which are transverse cross-sectional representations. In particular, the lubricator roll 21 provides substantially uniform dispensing of oil from the apertures 29—29 during rotation, despite the decrease in the quantity of silicone oil in reservoir 32 during use. This uniform dispensing in turn facilitates uniform application of the oil to the surface 31 of applicator roll 22 (FIG. 2) and, hence to surface 17 of the fuser roll 11.

The lubricator roll 21 comprises a first circular cylinder 35 which has the apertures 29—29 formed therein and a second circular cylinder 40 which is fixedly mounted within the first cylinder 35. As shown most clearly in FIGS. 4A-4D, the second cylinder 40 is slotted. Using the counter-clockwise direction shown in FIG. 2 as reference for the lubricator roll 21, an inward bent flange 33 at the leading edge of inner cylinder slot 34 directs oil from the reservoir 32 into an annular cavity 36 defined by outer surface 37 of the second, inner cylinder 40 and interior surface 38 of the first, outer cylinder 35. An outward bent flange 39 at the trailing edge of the slot 34 engages interior surface 38 thereof behind the apertures 29—29 (in the counter-clockwise sense) and closes the cavity 36 so that the cavity defines a reservoir 41 of oil.

Figure 4D:
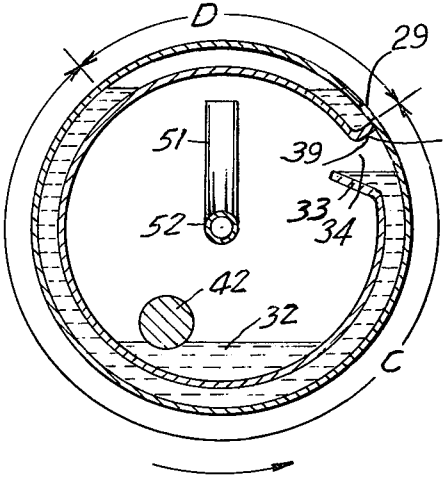
FIG. 4A, 4B, 4C, and 4D are transverse cross-sectional views of the lubricator roll of the present invention, taken along the lines 4—4 in FIG. 1 and illustrating the decreased effect of oil level on dispensing.
Figure 4C:
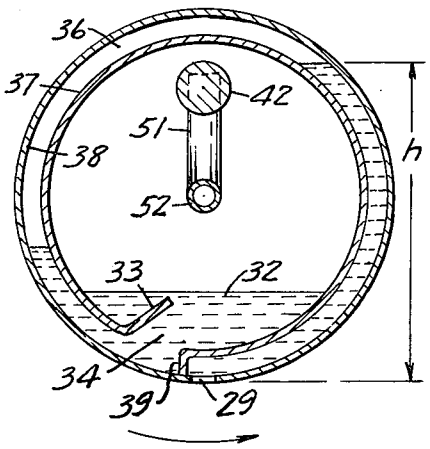
Figure 4B:
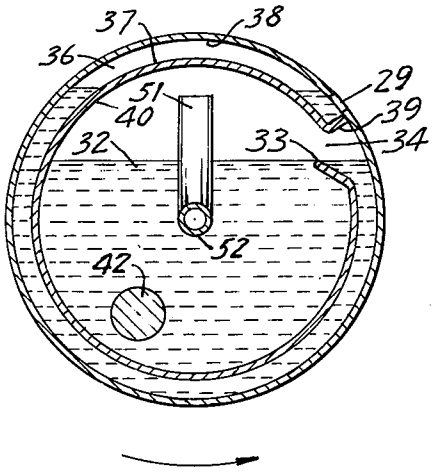
Figure 4A:
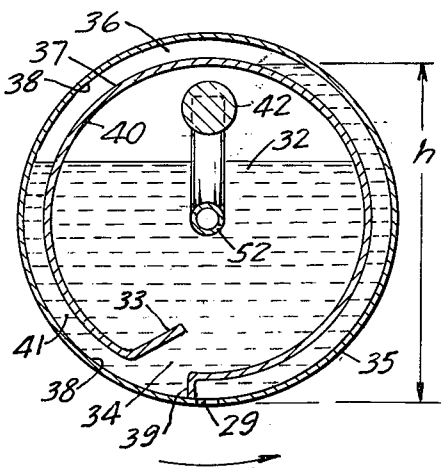

The reservoir 41 and the scooping action of leading edge flange 33 provide the aforementioned substantially uniform supply of oil to the apertures 29—29 for most of each revolution of the roll 21, over a wide range of oil levels in the reservoir 32. This is indicated by FIGS. 4A and 4B, wherein the level of oil in reservoir 32 is relatively high and the apertures are moving, respectively, at their lowest and toward their highest position; and by flanges 4C and 4D, wherein the reservoir level is relatively low and the apertures are again moving, respectively, at their lowest and toward their highest position. In each of the four different illustrated situations, the apertures 29—29 are in dispensing contact with oil held by the reservoir 41. Of particular interest is FIG. 4D, which shows that oil is dispensed from reservoir 41 although the apertures 29—29 are approaching the uppermost point of rotational movement and the level of oil in reservoir 32 is very low.

Oil flow through apertures 29—29 is a function of gravitational force and therefore flow essentially occurs only when there is "head", *h*, (see, e.g., FIGS. 4A and 4C) above the apertures. However, dispensing occurs over a major portion, about 270° C, of each revolution. Without the action of leading edge flange 33 and the reservoir-forming cavity 36, the apertures 29—29 would be in dispensing contact with the oil only for a period of rotational travel determined by the oil level in reservoir 32. As shown in FIG. 4D, the present invention extends dispensing contact over the 270° arc, C, and non-dispensing is limited to the rotational arc, D.

As shown in FIG. 3, counterweight means 42 is mounted in the lubricator roll 21 on the opposite side of the longitudinal axis 28 from the linear array of apertures 29—29. Actually, the counterweight means is a pair of counterweights 42—42, mounted by appropriate fasteners, such as screws 46 and 47, to the interior of the lubricator roll. The screws 46 and 47 are fastened to end structures 55—55 for the cylinders 35 and 40. The split counterweight arrangement precludes interference with vent 48, which is discussed infra. When the applicator roll 22 (FIG. 2) disengages the lubricator roll 21, the counterweights 42—42 normally bring the lubricator roll to rest with apertures 29—29 at the highest radial or top dead center position. With the apertures so positioned, oil leakage is prevented when the roll 21 is at rest.

In the event the lubricator roll 21 comes to rest with the counterweights 42—42 in the top dead center position, where they may be ineffective in overcoming the slight frictional force which impedes rotation, biasing means is provided for displacing the roller sufficiently to allow the counterweights to move the roll. The biasing means may comprise a pair of magnets 49—49 having opposed, like magnetic poles. One of the pair is mounted to the copier frame, typically by a screw 50. The second magnet of the pair is mounted on one end of the lubricator roll 21 by the counterweight screw 46 so that the second magnet is opposite the first magnet when the counterweights are at top dead center. The force of repulsion between the two magnets then effects the requisite displacement of the counterweights 42—42 and the lubricator roll 42 to bring it to a rest position with the apertures 29—29 in roll 21 positioned upward to stop dispensing of oil.

The heat-induced build-up of internal pressure can "pump" oil from the lubricator roll 21 regardless of the radial position thereof. To prevent this, internal venting is provided. The aforementioned vent tube 48 is fixed and L-shaped and has one leg 51 extending into the air space above the reservoir 32 of silicone oil. Second leg 52 extends coaxially with fixed axle shaft 53 and vents from the shaft via opening 54. A sealed ball bearing 56 positioned within end structure 55 and a non-sealed ball bearing 61 positioned within end structure 60 support the lubricator roll 21 for rotation on shafts 53—53, which are in turn supported by standards 57—57 or the like affixed to the copier. This coaxial arrangement permits the vent to be fixed in an upright position to provide continuous venting and equalization of pressure with the ambient atmosphere.

To illustrate application of the present invention, exemplary lubricating-cleaning apparatus 10, FIG. 1, includes a lubricator roll 21 approximately 57 mm. in diameter and 246 mm. in length containing about 300 ml. of oil when filled. The oil is added via tapped bore 58 (FIG. 3) after backing out screw 59. Silicone oil of 500 centistoke viscosity is used. Eight apertures 29—29 which are approximately 0.40 mm. in diameter are used. The applicator roll 22 is approximately 52 mm. in diameter and 264 mm. in length and has a polyester felt surface 31 (FIG. 2) of about 1.65 mm. thickness. The spreader roll 23 is approximately 13 mm. in diameter and is made of steel. As is typical for copying applications, the fuser roll 11 (diameter 64 mm.; length 274 mm.) is heated to temperatures of about 300° F. At these temperatures, the apparatus 10 provides lubrication and cleaning sufficient to virtually eliminate off-setting. After more than 100,000 cycles of use, the only service necessary has been to replace the felt-covered applicator roll and add oil.

Having described the present invention with reference to a preferred embodiment, it will be understood that possible modification may be made without departing from the spirit and scope of the present invention as recited in the appended claims.

I claim:

1. A rotatable roll for dispensing liquid, comprising:

a first cylinder having an interior surface circumscribing a longitudinal axis of rotation and apertures therein defining an array substantially parallel to the axis of rotation;

a second cylinder mounted within said first cylinder and having outer and inner surfaces, the outer surface defining a narrow annular cavity with said interior surface, and the inner surface defining a reservoir for liquid and defining an air space above said reservoir; and said second cylinder having a longitudinal opening defined in a preferred direction of rotation by extending, generally radially-directed flanges at leading and trailing longitudinal edges, said flange on the leading edge of the array extending inward for directing liquid from said reservoir into the cavity during rotation of the roll, said flange on the trailing edge of the opening extending outward and enclosing the cavity behind the apertures to define a second reservoir communicating with the apertures; and vent means communicating with said air space for venting air therefrom to equalize pressure within the roll with the ambient external pressure.

2. The roll of claim 1, wherein at least said first cylinder is of a circular cross-section and at least the outer surface of said second cylinder is substantially concentric with the interior surface of said first cylinder.

3. A roll rotatably mounted to axle means extending from a fixed support for applying liquid to a surface in contact with the roll, comprising:

a first, hollow, closed cylinder mounted for rotation on the axle means and having apertures forming an array substantially parallel to the rotational axis of said first cylinder;

a second cylinder mounted within said first cylinder defining a reservoir for liquid and defining a narrow annular cavity with the interior surface of said first cavity;

said second cylinder having a longitudinal opening defined in a preferred direction of rotation by an inward extending leading edge and an outward extending trailing edge enclosing the cavity behind the apertures; and a fixed vent tube having a first portion thereof extending upward within said second cylinder and a second portion thereof extending exteriorly of said roll via the axle means for pressure relief.

4. The roll of claim 3, further comprising:

at least a counterweight mounted within said roll diametrically opposite said array of apertures; and biasing means acting between the support and said roll for biasing the roll from the position at which said counterweight is at the top of its rotational orbit.

5. The roll of claim 4, wherein said biasing means comprises first and second magnets of substantially like polarity mounted, respectively, on one end of the roll and on the support adjacent the one end.

6. Apparatus mounted on support means for cleaning and lubricating the surface of an article advancing past the apparatus in contact therewith, comprising:

first and second rolls mounted to the support means for rotational movement;

said second roll being adapted for rotation and having an absorbent surface and being mounted for simultaneously engaging said first roll and the advancing surface for rotating at least said first roll;

said first roll having an array of apertures substantially parallel to the axis of rotation thereof and a cylindrical reservoir structure therein defining a reservoir and an air space above said reservoir and forming a narrow annular cavity with an interior surface of said first roll, said reservoir structure having a longitudinal opening along a preferred direction of rotation defined by an inward extending leading edge for scooping liquid from said reservoir into the cavity during rotation and by an outward extending trailing edge enclosing the cavity behind the apertures along the direction of rotation; and an air vent connecting said air space to the atmosphere external to said first roll.

7. The apparatus of claim 6, wherein said first roll further comprises a vent tube having a first end portion extending to the exterior of said first roll via the support means and a second, opposite end portion communicating with the interior of said first roll above the liquid level in the reservoir for maintaining pressure within said first roll at substantially the external ambient pressure.

8. The apparatus of claim 6, further comprising:

a counterweight mounted within said first roll diametrically opposite said array of apertures; and biasing means acting between the support means and said first roll tending to bias said first roll from the position for which said counterweight is at the top of its rotational orbit.

9. The apparatus of claim 6, further comprising a roll fixedly mounted relative to said second roll for rotational engagement thereby to distribute liquid on the surface of said second roll.

10. In a copier having a heated fusing roll adapted to fuse an image formed on a sheet-like support, the combination of:

an oil applicator mounted on said copier and comprising a hollow roll mounted for rotation on said copier and having at least an aperture in the periphery thereof, wherein a plurality of apertures forms a longitudinal array, at least a counterweight mounted in said hollow roll diametrically opposite said aperture, and a cylindrical structure mounted within and substantially conforming to the interior contour of said hollow roll to form (1) a first oil reservoir between said cylindrical structure and said hollow roll and (2) a second oil reservoir within said structure, said structure having a longitudinal opening defined along a preferred direction of rotation by (a) an inward extending leading edge for scooping oil from said second reservoir to said first reservoir and by (b) an outward extending trailing edge closing said first reservoir behind said apertures relative to the direction of travel;

a roll having an absorbent peripheral surface mounted to the copier on pivotal brackets and adapted for rotational movement thereon for simultaneous engagement with the fusing roll and said hollow roll for wiping the fusing roll and transferring oil thereto from said oil applicator;

a roll mounted for contact by said absorbent roll for being rotated by said absorbent roll upon rotation thereof to uniformly distribute oil on said absorbent roll;

and biasing means acting between said hollow roll and the copier for displacing said hollow roll from the position for which said counterweight is top dead center.

* * * * *

UNITED STATES PATENT AND TRADEMARK OFFICE

CERTIFICATE OF CORRECTION

PATENT NO. : 4,040,383

DATED : August 9, 1977

INVENTOR(S) : John D. Vandervort

It is certified that error appears in the above-identified patent and that said Letters Patent are hereby corrected as shown below:

Column 1, line 24, after "roller" insert -- to --.

Column 4, line 54, change "42" to -- 21 --.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*